US008496503B2

(12) United States Patent
Lamoureux et al.

(10) Patent No.: US 8,496,503 B2
(45) Date of Patent: Jul. 30, 2013

(54) FEMALE, MALE ELECTRICAL CONNECTOR AND ELECTRICAL CONNECTION USING THIS FEMALE AND/OR MALE ELECTRICAL CONNECTOR

(75) Inventors: Laurent Lamoureux, Ribecourt Dreslincourt (FR); Vincent Jamet, Aubervilliers (FR)

(73) Assignee: Saint-Gobain Glass France, Courbevoie (FR)

( * ) Notice: Subject to any disclaimer, the term of this patent is extended or adjusted under 35 U.S.C. 154(b) by 32 days.

(21) Appl. No.: 13/056,313

(22) PCT Filed: Jul. 29, 2008

(86) PCT No.: PCT/FR2008/051423
§ 371 (c)(1),
(2), (4) Date: Jan. 28, 2011

(87) PCT Pub. No.: WO2010/012872
PCT Pub. Date: Feb. 4, 2010

(65) Prior Publication Data
US 2011/0130054 A1 Jun. 2, 2011

(51) Int. Cl.
*H01R 4/48* (2006.01)

(52) U.S. Cl.
USPC ..... 439/860

(58) Field of Classification Search
USPC ..... 439/855, 860, 883, 909
See application file for complete search history.

(56) References Cited

U.S. PATENT DOCUMENTS

| | | | | |
|---|---|---|---|---|
| 2,291,674 | A * | 8/1942 | Alden | 439/342 |
| 2,640,871 | A * | 6/1953 | Carbary | 257/658 |
| 3,728,669 | A * | 4/1973 | Churla | 439/859 |
| 5,167,543 | A * | 12/1992 | Wurster | 439/851 |
| 5,322,459 | A | 6/1994 | Spinnato | |
| 5,863,227 | A | 1/1999 | Bell, Jr. | |

(Continued)

FOREIGN PATENT DOCUMENTS

| | | |
|---|---|---|
| FR | 2 685 558 | 6/1993 |
| FR | 2 688 945 | 9/1993 |
| WO | 2007 136569 | 11/2007 |

OTHER PUBLICATIONS

International Search Report Issued May 13, 2009 in PCT/FR08/051423 filed Jul. 29, 2008.

*Primary Examiner* — Renee Luebke
*Assistant Examiner* — Larisa Tsukerman
(74) *Attorney, Agent, or Firm* — Oblon, Spivak, McClelland, Maier & Neustadt, L.L.P.

(57) ABSTRACT

A female electrical connector including at least a distal wiring part configured to be connected to an electric cable and at least a proximal connection part including an opening in an overall shape of a ring directed along a central axis, the ring configured to collaborate with an appendage belonging to a male electrical connector directed along a central axis so as to allow the two connectors to be electrically connected via a plurality of tabs connected to the ring, each tab including a base attached to the ring and a head distant from the ring and that comes into contact with the appendage, and at least one retaining tab in the shape of a claw and at least one electrical connection tab in the shape of a vane, the claw having a base of a width greater than or equal to the width of its head and the vane having a base of a width less than the width of its head.

21 Claims, 6 Drawing Sheets

U.S. PATENT DOCUMENTS 6,039,616 A 3/2000 Pereira et al.
6,249,966 B1 6/2001 Pereira et al.
6,520,812 B1 2/2003 Machado
7,083,481 B2 8/2006 Pereira et al.
2006/0264123 A1* 11/2006 Sergi ..... 439/860
2007/0287322 A1 12/2007 Machado et al.

* cited by examiner

FEMALE, MALE ELECTRICAL CONNECTOR AND ELECTRICAL CONNECTION USING THIS FEMALE AND/OR MALE ELECTRICAL CONNECTOR

TECHINICAL FIELD

The invention relates to a female/male connection used for example to transmit electrical current to a glazing heating system or to a glazing antenna system, the glazing in particular being vehicle glazing.

BACKGROUND

At the present time, vehicle heated glazing, and particularly rear screens, receive their supply of electrical current through a pre-tinned connection and the cable is electrically soldered to the glazing at an advanced shop, that is to say on the vehicle production and assembly line, by the motor manufacturer.

This is impractical and motor manufacturers have high hopes of being able to fit, directly into the opening in the bodywork, glazing that is ready to be connected to the rest of the vehicle electrical system.

The glass maker therefore supplies the motor manufacturer with glazing comprising a male element already fixed to the glazing, and once the glazing has been fitted into the opening in the bodywork, all that is then required is for a female connection element to be clipped onto the male element in order to connect the electrical elements of the glazing to the wiring harness of the vehicle. Electrical connection to the surface of the glazing is thus performed at an advanced shop, by clip-fastening.

This solution makes it easier to pre-assemble the wiring harness using a clip-fastened rather than a soldered, electrical connection.

There is thus no longer any need to have skilled soldering performed in the various advanced shops, the electrical connection therefore becomes more reliable, the risk of glazing cleavage is eliminated, and it becomes possible to standardize the connection (which then becomes the same for all functions): antenna, heating, opening command, brake lights, etc.

A male connector and a female connector which could be used for the abovementioned application are known from the prior art, from American patents U.S. Pat. No. 6,039,616 and U.S. Pat. No. 6,520,812, respectively.

However, the electrical connection thus made through the collaboration of these two connectors is not satisfactory because it is too easy to unclip.

In order to measure the extraction force needed to unclip a connection, it is possible to use a tensile testing machine and apply tension to the electrical connection.

Laboratory tests have shown that the average insertion-force value for so-called "power" connections, for example for heating, is 56.5 N, but that the average extraction-force value for these power connections is 64.2 N, which is very similar.

It is preferable for the extraction-force value to be reasonable, in order to allow the glazing to be changed if necessary without the need to change the female electrical connector, but such a small difference between the two opposing force values is unacceptable because it means that there is a risk that the female connector will all too readily become unclipped from the male connector.

Admittedly, it is possible to encapsulate the electrical connection in a plastic but then it becomes impossible to change the glazing without changing the female connector: when the glazing is changed, the entire electrical connection has also to be changed, this of course increasing the cost of the replacement glazing.

SUMMARY

According to an embodiment of the present invention, the female electrical connector usually has at least a distal wiring part intended to be connected to an electric cable and at least a proximal connection part comprising an opening in the overall shape of a ring directed along a central axis, said ring being intended to collaborate with an appendage belonging to a male electrical connector directed along a central axis so as to allow the two connectors to be electrically connected via a plurality of tabs connected to said ring. each tab having a base which is attached to the ring and a head which is distant from the ring and which comes into contact with said appendage in order to make the electrical connection.

The male electrical connector usually comprises at least one appendage directed along a central axis, said male electrical connector being intended to collaborate with the aforementioned female electrical connector.

The present invention intends to remedy the disadvantages of the prior art by proposing a female electrical connector which has an average extraction force that is higher than the average insertion force.

The present invention relies on a separate analysis of the various means needed to operate a female electrical connector of the type discussed hereinabove and collaborating with a male electrical connector.

It so happens that the means that hold the female electrical connector on the male electrical connector can be separated from the means needed to pass current between the electrical connectors.

Now, the flexibility of the means needed for the passage of current has to be great so as to ensure that these means are always pressed firmly against the male electrical connector, whereas the flexibility of the means used to hold the female electrical connector on the male electrical connector has to be proportionately lower, so that extraction will not be excessively easy.

This female electrical connector is notable in that it comprises at least one (and preferably at least two) retaining tab(s) in the shape of a claw and at least one (and preferably at least two) electrical connection tab(s) in the shape of a vane, the claw(s) having a base of a width greater than or equal to the width of its(their) head(s) and the vane(s) having a base of a width less than the width of its(their) head(s).

Thus, the electrical connection vane(s) is(are) more flexible than the retaining claw(s) and it is then possible to obtain an average extraction force that is higher than the average insertion force while at the same time maintaining good reliability for the electrical connection.

The width of the head of at least one vane (and preferably of all the vanes) is preferably at least 1.5 times, and more preferably still at least two times, or even at least 2.5 times, larger than the width of the base of this vane (these vanes).

The height of a (of the) vane(s), measured from the underside of the ring, is preferably at least twice the height of a(the) claw(s) measured from this same reference point.

The tabs according to the invention also preferably have the same thickness as one another, this thickness also being constant from their base to their head.

The height of a(the) claw(s), measured from the underside of the ring, is preferably less than the height of the appendage belonging to the male electrical connector, said height of a(the) claw(s) more preferably still being substantially equal to half said height.

When the female electrical connector is not yet collaborating with said male electrical connector, the interior distance between the heads of two vanes that are diametrically opposed with respect to the axis A is preferably at least 90% of the distance between two outer walls of the appendage.

When the female electrical connector is not yet collaborating with said male electrical connector, the interior distance between the heads of two claws that are diametrically opposed with respect to the axis A is preferably at least 90% of the distance between two outer walls of the appendage.

This interior distance between the heads of two vanes that are diametrically opposed with respect to the axis A is also, in an alternative form, less than the interior distance between the heads of two claws that are diametrically opposed with respect to the axis A.

When the female electrical connector is collaborating with said male electrical connector, the head of at least one vane (and preferably of all the vanes) is preferably in surface-to-surface contact with said appendage belonging to the male electrical connector, while the head of at least one claw (and preferably of all the claws) is in linear, or even spot, contact with said appendage.

This surface-to-surface contact between each vane head and the appendage is preferably over an area of between 1 $mm^2$ and 5 $mm^2$, preferably at least 1.5 $mm^2$, or at least 2 $mm^2$, or even at least 3 $mm^2$.

In an alternative form, the claws and the vanes alternate around the periphery of the ring in such a way that the angle between a claw and an adjacent vane on the periphery of the ring is always the same and, in particular, is of the order of 45° or of the order of 30° or of the order of 22.5°.

An appendage belonging to a male electrical connector capable of collaborating with the female connector according to the invention may have a completely circular exterior section and thus exhibit axial symmetry, or may exhibit no such axial symmetry and thus have a particular orientation: in this regard, it may be of circular exterior section truncated at least once, or even of circular exterior section truncated a number of times, or alternatively, may have an exterior section that is non-circular with several sides or faces.

The male electrical connector is notable in that it comprises at least one appendage that has at least one flat face, or even several flat faces, that is to say one (or more) non-curved face(s) or planar face(s).

In a particularly advantageous alternative form, this male electrical connector comprises at least two appendages each directed along a central axis, each appendage comprises at least one flat face, the distance between two faces being greater than the sum of the widths of two rings.

The central axes of the appendages are preferably parallel to one another in space. The flat faces need not be parallel in space.

The invention also relates to the use of the female electrical connector according to the invention to make an electrical connection with a male electrical connector comprising at least one appendage, particularly with a male electrical connector positioned on a conducting surface of a glazed element, and in particular a male electrical connector according to the invention, the force required to extract the female electrical connector from the male electrical connector preferably being between 1.2 and 5 times and preferably at least 1.4 times, or at least 1.5 times, greater than the force required to insert the female electrical connector onto the male electrical connector.

Furthermore, the force required to insert the female electrical connector onto the male electrical connector is preferably at most 60 N or at most 55 N, and the force required to extract the female electrical connector from the male electrical connector is preferably at least 80 N or at least 85 N or even at least 90 N.

The invention also relates to the use of the male electrical connector according to the invention to make an electrical connection with a female electrical connector, and thus relates in particular to the use of a male electrical connector according to the invention positioned on a conducting surface of a glazed element, and, in particular, to make an electrical connection with a female electrical connector according to the invention.

The invention thus also relates to the electrical connection that uses the female electrical connector according to the invention and/or the male electrical connector according to the invention to make an electrical connection, particularly when the male connector is positioned on a conducting surface of a glazed element.

When a female electrical connector according to the invention is collaborating with a male electrical connector according to the invention, the, or at least one, planar face of the appendage belonging to the male electrical connector preferably collaborates with a vane belonging to the female electrical connector.

Advantageously, this electrical connection using the female electrical connector according to the invention and/or the male electrical connector according to the invention can be used to produce reliable mechanical collaboration between the female electrical connector and the male electrical connector while at the same time achieving reliable electrical collaboration between the female electrical connector and the male electrical connector.

Advantageously, this electrical connection using the female electrical connector according to the invention and/or the male electrical connector according to the invention is easy to manufacture, particularly by pressing/forming a metal. It is therefore not expensive.

BREIF DESCRIPTION OF THE DRAWINGS

The details and advantageous features of the invention will become evident from the following non-limiting examples illustrated using the attached figures.

Figure 17:
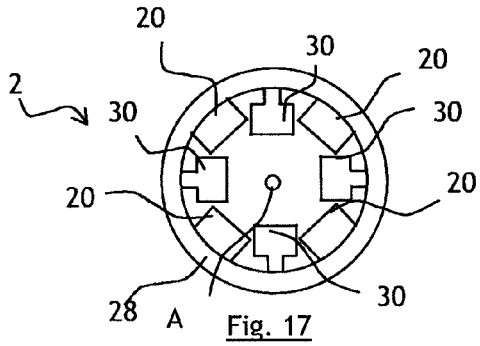
Figure 18:
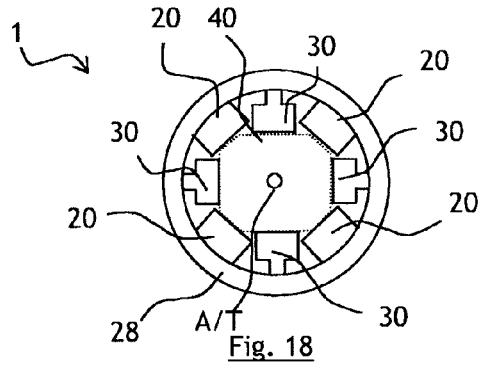
Figure 19:
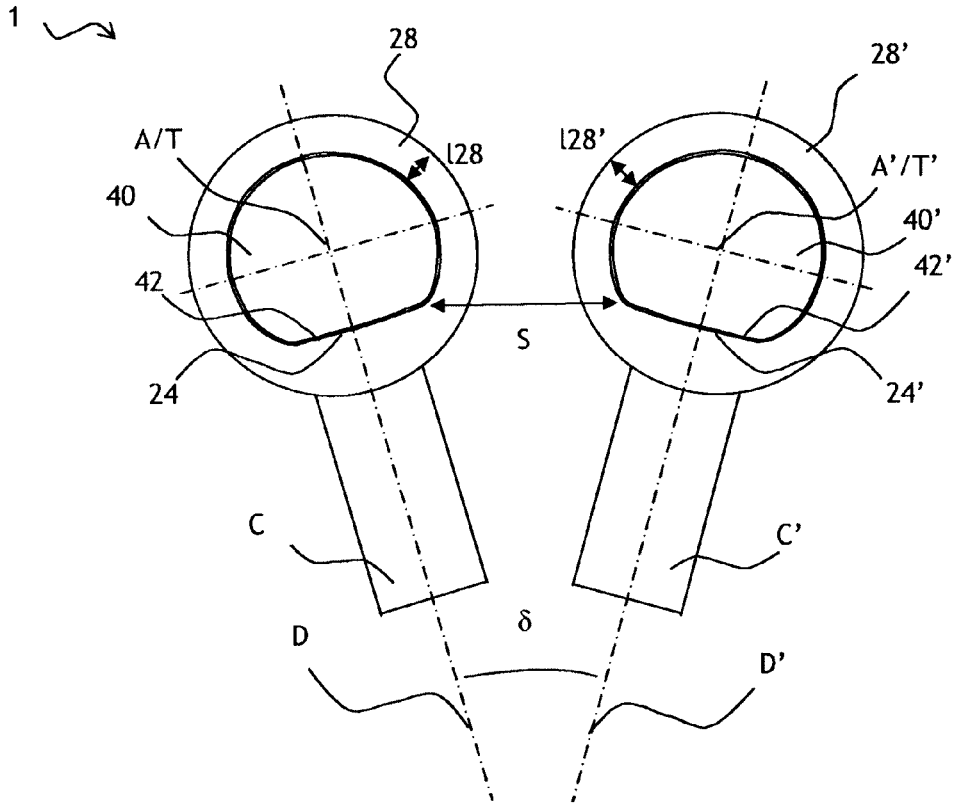

FIG. 17 illustrates a plan view of a third alternative form of the proximal connection part of the connector according to the invention, and FIG. 18 illustrates a view of this same part collaborating with an appendage of octagonal cross section; and FIG. 19 illustrates a plan view of another alternative form of embodiment of the electrical connection according to the invention, in which a female electrical connector with two distal wiring parts is collaborating with a male electrical connector according to the invention that has two appendages.

DETAILED DESCRIPTION

Figure 1:
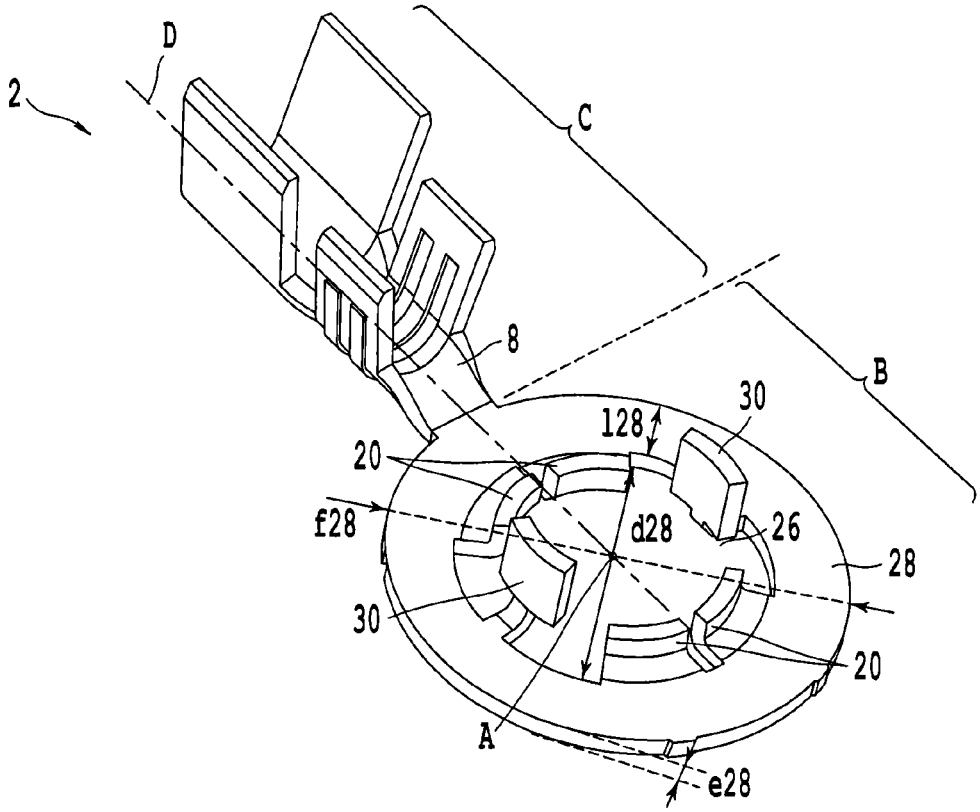
FIG. 1 illustrates a perspective view of the female connector according to the invention.

One exemplary embodiment of the female electrical connector 1 according to the invention is illustrated in FIG. 1.

This female electrical connector 2 has a distal wiring part C intended to be connected to an electric cable and a proximal connection part B.

The female electrical connector 2 according to the invention may have two (or even more) proximal connection parts B and two (or more) distal wiring parts C each intended to be connected to an electric cable or one distal wiring part C intended to be connected to several electric cables. Each proximal connection part B therefore preferably has one (or more) retaining tab(s) and one (or more) electrical connection tab(s) according to the present invention.

The distal wiring part C has a groove 8 to accommodate the stripped end of the electric cable. In cross section, this groove is substantially U-shaped and the legs of this U can be bent over toward the base in order to crimp the end of the cable.

The distal wiring part C has axial symmetry about an axis D passing through the bottom of the groove 8.

The proximal connection part B comprises an opening 26 in the overall shape of a ring 28 which in this instance has a circular interior shape and an exterior shape that is also circular and concentric with the previous one, said ring being directed along a central axis A.

The proximal connection part B also has axial symmetry about an axis which in this instance coincides with the axis D of the distal wiring part C.

The axes A and D are thus perpendicular to one another.

It is entirely possible to conceive of the opening 26 not being circular but having several faces, preferably an even number of such faces, so as to maintain symmetry in its mechanical disposition with respect to the axis A and the axis D.

Figure 2:
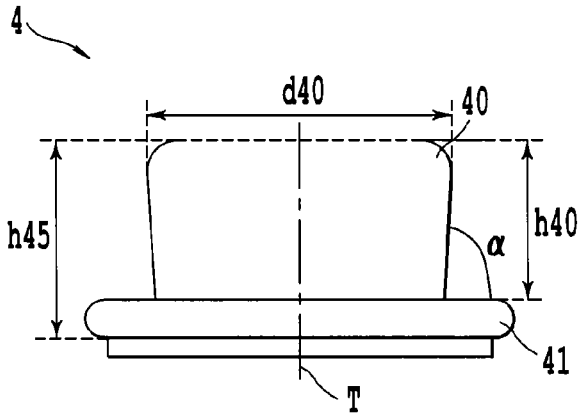
FIG. 2 illustrates a view in axial section of a male connector that can be used with the female connector of FIG. 1.

The ring 28 of the proximal connection part B is intended to collaborate with an appendage 40 belonging to a male electrical connector 4 illustrated by way of example in FIG. 2.

This appendage 40 is directed along a central axis T.

The appendage 40 is, for example, a cylinder (or tube) with an outside diameter d3 smaller than the inside diameter d28 of the ring 28. f28 denotes the outside diameter of the ring 28.

Thus, because the ring does not come into direct contact with said appendage, it may have an interior shape similar in cross section to that of the appendage and which thus mimics the exterior contour of the appendage or some other shape. It may also have an exterior shape similar to the cross-sectional shape of the appendage and which thus mimics the exterior contour of the appendage, or some other shape.

The male connector 4 comprises, in addition to the appendage 40, a base 41 of an outside diameter greater than the outside diameter of the appendage 40. It is via this base that the male connector 4 is electrically connected, for example, to a conducting surface of a glazed element. h2 denotes the overall height of the male connector.

The appendage 40 may thus be in the overall shape of a cylindrical cone, with a part close to the base 41 that is not as wide as the part remote from the base 41. The angle $\alpha$ of the wall of the appendage 40 with respect to the base 41 may thus be slightly smaller than 90°, and for example may be 87° or 85°.

The appendage 40 may thus have at least one flat face and thus in cross section, parallel to the base 41, be of truncated circular shape.

The appendage 40 may also have several flat faces and thus in section, parallel to the base 41, be in the shape of a triangle, a square, a rectangle, a diamond, a hexagon, an octagon, a pentagon, etc.

Collaboration between the female connector 2 and the male connector 4 to make an electrical connection between the two connectors is achieved by fitting the ring 28 around the appendage 40 in such a way that their respective axes A and T coincide in space.

Because the male connector 4 is, for example, soldered onto a conducting surface of a glazed element such as vehicle glazing, the translational movement of the ring 28 along the axis T such that the axis A of the ring 28 coincides with the axis T thus allows the female connector 2 to be slipped over the male connector 4.

However, this collaboration is such that the ring 28 does not come into direct contact with the appendage 40: it is tabs, mechanically connected to the ring, which provide mechanical retention against the appendage and electrical connection with this appendage.

Each tab has a base which is physically attached to the ring and a head which is not physically attached to the ring but which is distant from the ring and comes into contact with said appendage at the time of collaboration.

According to the invention, the female electrical connector 2 comprises at least two tabs, and preferably an even number of tabs, and the tabs are split into two categories:

- at least one (or a plurality of) retaining tab(s) in the shape of a claw 20 which has (each have) the essential function of providing mechanical collaboration between the female connector and the male connector, and
- at least one (or a plurality of) connection tab(s) in the shape of a vane 30 which has (each have) the essential function of providing the electrical connection between the female connector and the male connector.

This does not mean that no electrical connection is performed by the claw(s) or that no mechanical collaboration is afforded by the vane(s), but means that each category of tab has its own configuration designed to meet the objectives of the essential function devolved upon it:

- each claw 20 having a base 21 of a width 121 greater than or equal to the width 122 of its head 22, and each vane 30 having a base 31 of a width 131 less than the width 132 of its head 32.

However, these are not the only properties assigned to each category of tab.

Figure 3:
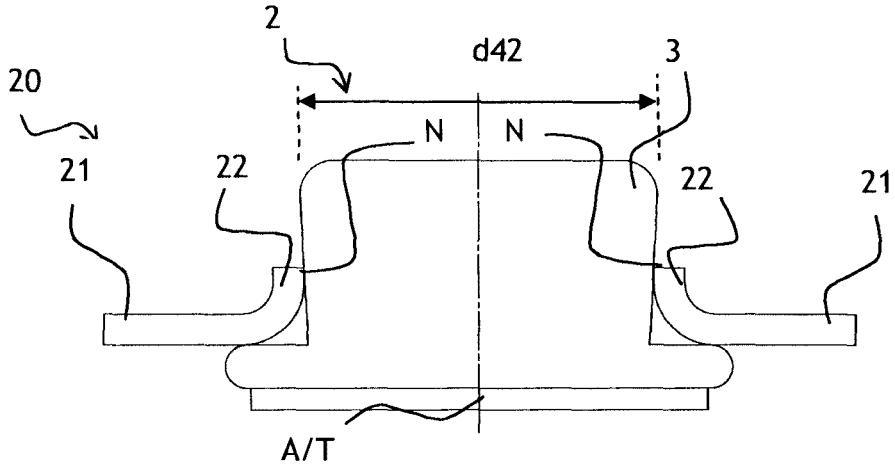
FIG. 3 illustrates a view in axial section of the collaboration between two claws belonging to the connector of FIG. 1 and the connector of FIG. 2.
Figure 4:
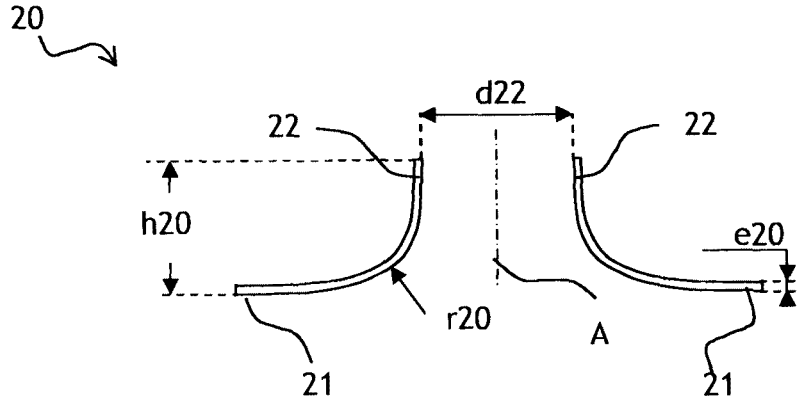
FIG. 4 illustrates a view in axial section of two claws of the connector of FIG. 1.
Figure 5:
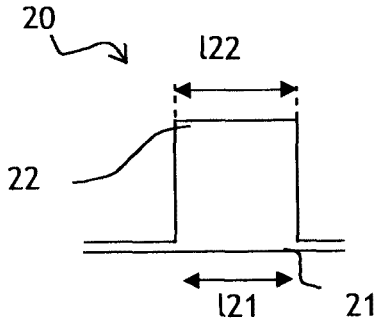
FIG. 5 illustrates a front view of a claw belonging to the connector of FIG. 1.

Thus, as a preference, for each claw 20:

the head 22 is in linear contact N with the appendage 40 belonging to the male electrical connector 4, as can be seen in FIG. 3;

the interior distance d22 (in this instance the inside diameter), visible in FIG. 4, between the heads 22 of two claws that are diametrically opposed with respect to the axis A is at least 90% of the exterior width d40, that is to say the distance between the outer walls (in this instance the outside diameter), of the appendage 40 when the female electrical connector 2 is not collaborating with said male electrical connector 4;

the height h20 of each claw, measured from the underside of the ring 11, is less than the height h40 of the appendage 40 belonging to the male electrical connector.

Figure 6:
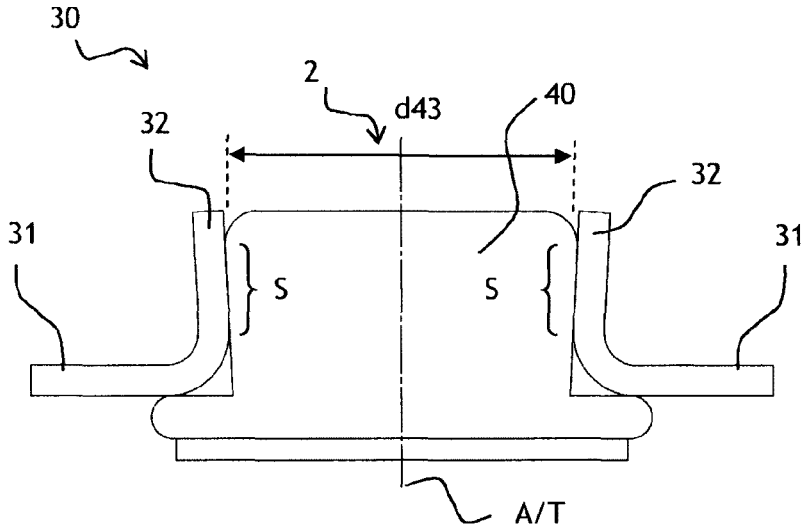
FIG. 6 illustrates a view in axial section of the collaboration between two vanes of the connector of FIG. 1 and the connector of FIG. 2.
Figure 7:
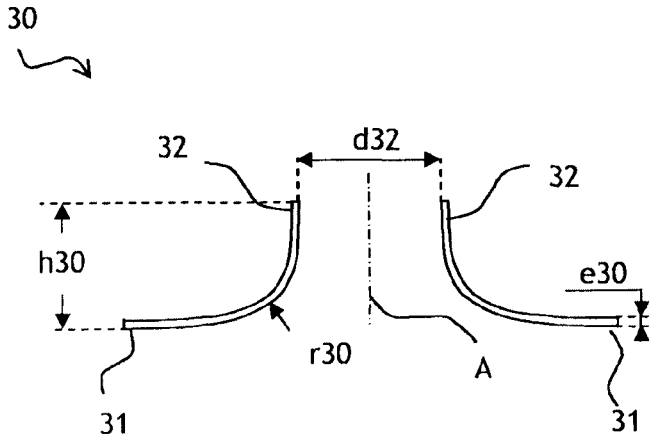
FIG. 7 illustrates a view in axial section of two vanes belonging to the connector of FIG. 1.
Figure 8:
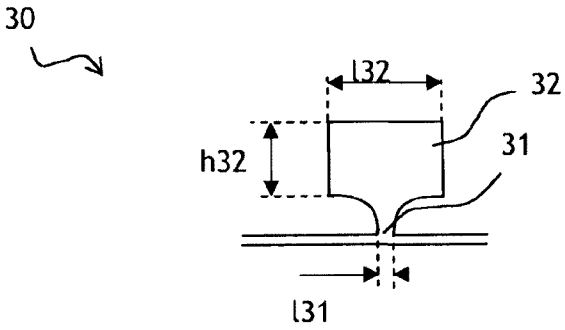
FIG. 8 illustrates a front view of a vane belonging to the connector of FIG. 1.

Also, as a preference, for each vane 30:

the head 32 is in surface-to-surface contact S, or even spot contact, with said appendage 40 belonging to the male electrical connector 4, as can be seen in FIG. 6;

the interior distance d32 (in this instance the inside diameter), visible in FIG. 7, between the heads 32 of two vanes that are diametrically opposed with respect to the axis A is at least 90% of the exterior width d40 between the outer walls (in this instance the outside diameter) of the appendage 40 when the female electrical connector 2 is not collaborating with said male electrical connector 4;

the height h30 of each vane, measured from the underside of the ring 11, is substantially equal to the height h40 of the appendage 40 belonging to the male electrical connector, or in any event, there is no need for the height h30 to exceed the height h40;

the height h30 of each vane, measured from the underside of the ring 11, is at least twice the height h20 of the claws 20 measured from this same reference point;

the width 132 of the head 32 of each vane is larger than the width 131 of the base 31 of these vanes, as may be seen in FIG. 8.

Also in the context of the invention, the width 131 of the base 31 of each vane 30 is preferably at least 1.5 times, and preferably at least two times, smaller than the width 121 of the base 21 of the claws 20.

Further, in each category of tab, the tabs are preferably in an even number, so as to maintain axial symmetry with respect to the axes A and D. It is then possible, on the one hand, to produce a claw clip using two claws that are diametrically opposed with respect to the axis A, and to produce, on the other hand, a vane clip using two vanes that are diametrically opposed with respect to the axis A.

When the female electrical connector 2 is introduced over the male electrical connector 4, the heads 32 of the vanes 30 part in a centripetal direction with respect to the axis A and the interior distance d32 between the heads 32 of two vanes that are diametrically opposed with respect to the axis A becomes substantially identical to the distance between the outer walls (in this instance the outside diameter) d40 of the appendage 40.

Likewise, when the female electrical connector 2 is introduced over the male electrical connector 4, the heads 22 of the claws 20 part in a centripetal direction with respect to the axis A and the interior distance d22 between the heads 22 of two claws that are diametrically opposed with respect to the axis A becomes substantially identical to the distance between the outer walls (in this instance the outside diameter) d40 of the appendage 40.

The female electrical connector 2 illustrated in FIG. 1 has four claws 20 and two vanes 30.

The tabs within one and the same category are positioned facing one another in pairs that are diametrically opposed with respect to said axis A of the ring: in this configuration, there is therefore no claw facing a vane across the axis A, or vice versa.

The table below gives possible values for each of the width, diameter or height parameters of FIGS. 2 to 8 (in mm):

| Connector 4 | Ring 28 | Claws 20 | Vanes 30 |
|---|---|---|---|
| h40 = 4 | d28 = 8.3 | h20 = 1.25 | h30 = 3 |
| h45 = 3 | f28 = 12 | l21 = 2 | l31 = 0.8 |
| d40 = 5.7 | l28 = 1.85 | l22 = 2 | l32 = 1.9 |
| | e28 = 0.5 | d22 = 5.5 | d32 = 5.4 |

Thus, the surface-to-surface contact S between each head 32 and the appendage 40 in this instance covers an area of the order of 4 $mm^2$. ($2\times1.9=3.8$ $mm^2$).

The total surface-to-surface contact between all the heads 32 and the appendage 40 is thus in this instance of the order of 8 $mm^2$. ($2\times2\times1.9=7.6$ $mm^2$).

The height h20 in this instance is substantially equal to half the height h3 and even slightly less than half said height h3.

The height h30 in this instance is identical to the height h3.

The interior distance d22 in this instance is equal to about 96.5% of the exterior distance d40 and the interior distance d32 is equal to about 94.7% of the exterior distance d40.

The width 131 of the base 31 of the vanes in this instance is about 2.5 times smaller than the width 121 of the base 21 of the claws.

For reasons of ease of manufacture, the fillet radius r20 between the base 21 and the ring 11 is the same as the fillet radius r30 between the base 31 and the ring 28; likewise, the thickness e20 of the material of which the claws 20 are made is identical to the thickness e30 of the material of which the vanes 30 are made and is identical to the thickness e28 of the ring 28: of the order of 0.5 mm.

However, it may be possible to envision, on the one hand, for the base 21 of at least one claw (and preferably of all the claws) to have an additional thickness of material to make the connection between this (these) claw(s) and the ring more rigid, for example having a thickness e20≧110% of e28, or even e20≧120% of e28 and/or, on the other hand, for the base 31 of at least one vane (and preferably of all the vanes) to have a reduction in the thickness of material to make the connection between this (these) vane(s) and the ring more flexible, for example having a thickness e30≦90% of e28, or even e30≦80% of e28. This solution then makes it possible to obtain an average extraction force that is greater than the average insertion force while at the same time maintaining good reliability in respect of the electrical connection.

Figure 9:
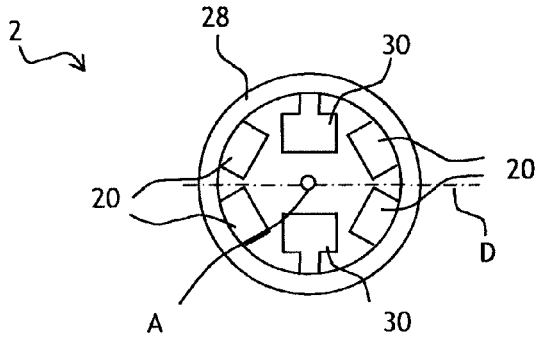
FIG. 9 illustrates a plan view of the proximal connection part of the connector of FIG. 1.

As can be seen in FIG. 9, the interior distance between the heads 32 of two vanes 30 that are diametrically opposed with respect to the axis A is less than the interior distance between the heads 22 of two claws 20 that are diametrically opposed with respect to the axis A. This is possible because the vanes 30 are more flexible than the claws 20.

The interior distance between the heads 32 of two vanes 30 that are diametrically opposed with respect to the axis A can also be substantially identical to the interior distance between the heads 22 of two claws 20 that are diametrically opposed with respect to the axis A, but, on the other hand, it is not conceivable for the interior distance between the heads 32 of two vanes 30 that are diametrically opposed with respect to the axis A to be greater than the interior distance between the heads 22 of two claws 20 that are diametrically opposed with respect to the axis A.

In this configuration, the axis D passes mid-way between two bases 22 of the two claws 20 that are adjacent on the periphery of the ring 28.

Figure 10:
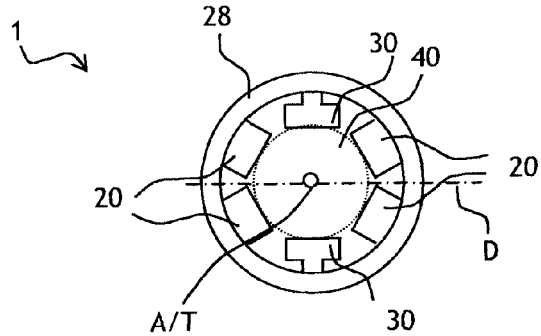
FIG. 10 illustrates a view of this same part collaborating with an appendage of circular cross section.

As may be seen from FIG. 10, the claws 20 are parted only very slightly as the circular appendage 40 passes between them, as a result of their rigidity, but the vanes 30 are parted to a far greater extent as the circular appendage 40 passes between them, because of their flexibility.

Figure 11:
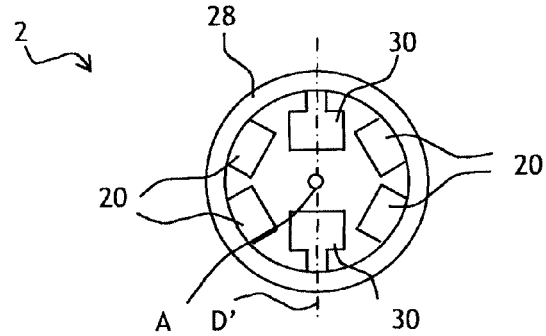
FIG. 11 illustrates a plan view of the proximal connection part of a connector directed at 90° with respect to that of FIG. 1.

FIG. 11 also illustrates another possible configuration for the positioning of the axis of the distal wiring part C, here termed D'.

In this configuration, the axis D' passes through the middles of the bases 32 of the two vanes 30 that are diametrically opposed with respect to the axis A.

Figure 12:
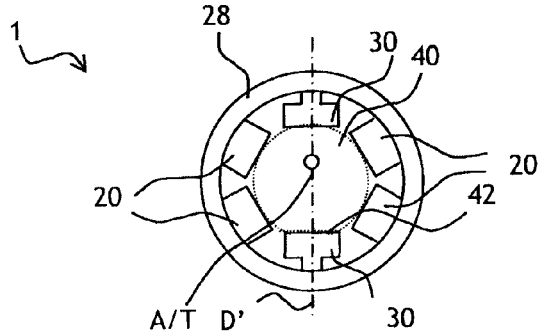
FIG. 12 illustrates a view of this same part collaborating with an appendage of circular cross section truncated just once.

In FIG. 12, the configuration of FIG. 11 is illustrated collaborating with an appendage 40 of circular cross section with one flat face 42, that is to say with one side face. This face 42 is produced in such a way that its plane runs parallel to the axis T of the appendage.

Figure 13:
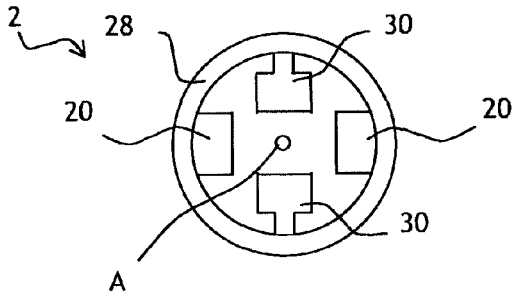
FIG. 13 illustrates a plan view of a first alternative form of the proximal connection part of the connector according to the invention.

FIG. 13 illustrates a configuration that is simpler than that of FIG. 9. In this configuration of FIG. 13, there are just two claws 20 and two vanes 30, the two claws being diametrically opposed with respect to the axis A and the two vanes being diametrically opposed with respect to the axis A.

It also so happens that the claws and the vanes alternate around the periphery of the ring 28 in such a way that the angle between a claw and an adjacent vane on the periphery of the ring is always the same: of the order of 45°.

Figure 14:
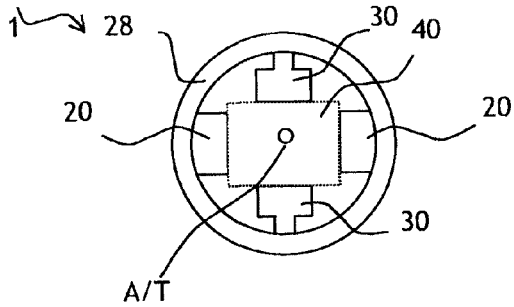
FIG. 14 illustrates a view of this same part collaborating with an appendage of rectangular cross section.

In FIG. 14, the configuration of FIG. 13 is illustrated collaborating with an appendage 40 of parallelepipedal, and more specifically of rectangular, cross section, which thus has four flat faces. These faces are produced in such a way that they are all parallel to the axis T of the appendage.

Figure 15:
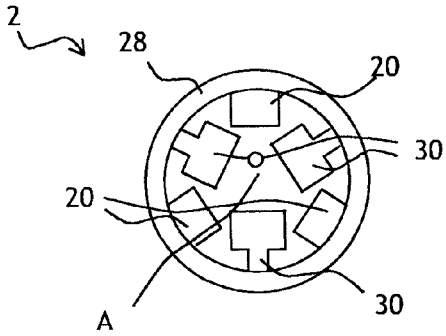
FIG. 15 illustrates a plan view of a second alternative form of the proximal connection part of the connector according to the invention.

FIG. 15 illustrates a more complex configuration than that of FIG. 13. In this configuration of FIG. 15, there are three claws 20 and three vanes 30 and the claws and the vanes are not diametrically opposed in pairs with respect to the axis A.

In the configuration of FIG. 15, the claws 20 and the vanes 30 are angularly distributed in such a way that the angle between all the claws 20 is always the same and the angle between the vanes 30 is always the same. It also so happens that the claws and the vanes alternate around the periphery of the ring 28 in such a way that the angle between a claw and an adjacent vane on the periphery of the ring is always the same: of the order of 30°.

Figure 16:
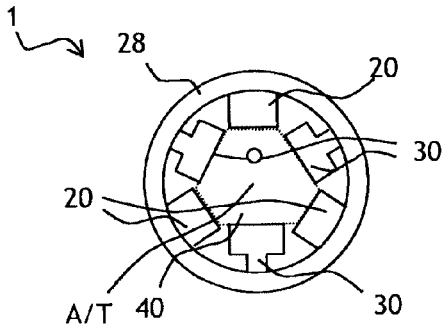
FIG. 16 illustrates a view of this same part collaborating with an appendage of hexagonal cross section.

In FIG. 16, the configuration of FIG. 15 is illustrated collaborating with an appendage 40 of hexagonal cross section, which thus has six flat faces. These faces are produced in such a way that they are all parallel to the axis T of the appendage.

The configuration of FIG. 15 could thus, for example, collaborate with an appendage 40 of triangular cross section, the three flat faces collaborating with the three vanes and the three claws collaborating spotwise with the three corners of the appendage.

FIG. 17 illustrates a more complicated configuration then that of FIG. 15. In this configuration of FIG. 17, there are four claws 20 and four vanes 30 and the claws and the vanes are diametrically opposed in pairs with respect to the axis A.

In the configuration of FIG. 17 also, the claws 20 and the vanes 30 are angularly distributed in such a way that the angle between all the claws 20 is always the same and the angle between the vanes 30 is always the same. It also so happens that the claws and the vanes alternate around the periphery of the ring 28 in such a way that the angle between a claw and an adjacent vane on the periphery of the ring is always the same: of the order of 22.5°.

In FIG. 18, the configuration of FIG. 17 is illustrated collaborating with an appendage 40 of octagonal cross section which thus has 8 flat faces. These faces are produced in such a way that they are all parallel to the axis T of the appendage.

The configuration of FIG. 17 could thus, for example, collaborate with an appendage 40 of rectangular cross section, the four flat faces collaborating with the four vanes and the four claws collaborating spotwise with the four corners of the appendage.

In the configuration of FIG. 19, the electrical connection 1 is formed of a male electrical connector as in an embodiment described above and of a female electrical connector as in an alternative embodiment.

The male electrical connector has two appendages 40, 40' each directed along a central axis T, T', and each appendage 40, 40' has one flat face 42, 42'.

The female electrical connector has two distal wiring parts C, C' and two proximal connection parts each comprising an opening in the overall shape of a ring 28, 28' and each directed along a central axis A, A'.

The distance S between the two flat faces 42, 42' is greater than the sum of the widths 128, 128' of two rings 28, 28'; this distance S is, in this instance, even greater than twice the sum of the widths 128, 128'.

These two faces 42, 42' are not mutually parallel and lie at an angle $\delta \geqq 10°$ and $\leqq 80°$.

FIG. 19 furthermore illustrates the fact that the axes D, D' of the distal wiring parts C, C' of the female electrical connector are not parallel and lie at the same angle $\delta$.

When the configuration set out hereinabove with reference to FIGS. 1 to 9 and 14 is used it is found that the average force required to insert the female electrical connector 2 onto the male electrical connector 4 is 54.4 N and that the average force required to extract the female electrical connector 1 from the male electrical connector 4 is 90.6 N.

Thus, the force required to extract the female electrical connector 2 from the male electrical connector 4 is, in this instance, about 1.66 times higher than the force required to insert the female electrical connector 1 onto the male electrical connector 4.

Both the female electrical connector 2 and the male electrical connector 4 are manufactured from an electrically conducting material such as, for example, CuSn9Ph12 bronze.

The present invention is described hereinabove by way of example. Naturally, a person skilled in the art can vary the invention in numerous ways without thereby departing from the scope of the patent as defined by the claims.

The invention claimed is:

1. A female electrical connector comprising:

a distal wiring part configured to be connected to an electric cable;

a proximal connection part including, a ring having an opening therethrough, the opening being aligned with a central axis of the ring, the ring being configured to collaborate with an appendage extending along a central axis of a male electrical connector, a plurality of tabs connected to the ring, each tab including a base attached to the ring and a head distant from the ring, the head of each tab contacting the appendage so as to provide an electrical connection when the female electrical connector is connected to the male electrical connector, the plurality of tabs including at least one claw that is a retaining tab in a shape of a claw, and at least one vane that is an electrical connection tab in a shape of a vane, the shape of the vane being distinct from the shape of the claw, wherein the claw includes a base and a head, a width of the claw base being greater than or equal to a width of the claw head, the base of the claw extending directly from a circumference of the opening in the ring in a direction of extension substantially perpendicular to the central axis of the ring, and the head of the claw being bent away from the base of the claw so as to extend in a direction transverse to the direction of extension of the base of the claw, wherein the vane includes a base and a head, a width of the vane base being less than a width of the vane head, the base of the vane extending directly from the inner circumference of the opening in the ring in the direction of extension substantially perpendicular to the central axis of the ring, and a direction of extension of the head of the vane extending in a direction transverse to the direction of extension of the base of the vane, and wherein the width of the vane base is smaller than the width of the claw base.

2. The female electrical connector as claimed in claim 1, wherein the width of the vane base is at least 1.5 times smaller than the width of the claw base.

3. The female electrical connector as claimed in claim 1, wherein the width of the vane head is at least 1.5 times larger than the width of the vane base.

4. The female electrical connector as claimed in claim 1, wherein a height of the vane, measured from an underside of the ring, is at least twice a height of the claw measured from the underside of the ring.

5. The female electrical connector as claimed in claim 1, wherein a height of the claw, measured from an underside of the ring, is less than a height of the appendage belonging to the male electrical connector, the height of the claw being substantially equal to half the height of the appendage.

6. The female electrical connector as claimed in claim 1, wherein the plurality of tabs includes at least two vanes, and wherein when the female electrical connector is not collaborating with the male electrical connector, an interior distance between the respective heads of the two vanes, which two vanes are diametrically opposed to each other with respect to the central axis of the ring, is at least 90% of an exterior width of the appendage.

7. The female electrical connector as claimed in claim 1, wherein the plurality of tabs includes at least two claws, and wherein when the female electrical connector is not collaborating with the male electrical connector, an interior distance between the respective heads of the two claws, which two claws are diametrically opposed to each other with respect to the central axis of the ring, is at least 90% of an exterior width of the appendage.

8. The female electrical connector as claimed in claim 7, wherein the plurality of tabs includes at least two vanes, and wherein an inside diameter between the respective heads of the two vanes, which two vanes are diametrically opposed to each other with respect to the central axis of the ring, is less than an inside diameter between the respective heads of the two claws.

9. The female electrical connector as claimed in claim 1, wherein when the female electrical connector is collaborating with the male electrical connector, the vane head is in surface-to-surface contact with the appendage belonging to the male electrical connector, and the claw head is in linear or spot contact with the appendage, wherein the surface-to-surface contact between the vane head and the appendage is over an area of at least 1.5 $mm^2$.

10. The female electrical connector as claimed in claim 9, wherein the surface-to-surface contact between the vane head and the appendage is over an area of at least 2 $mm^2$.

11. The female electrical connector as claimed in claim 9, wherein the surface-to-surface contact between the vane head and the appendage is over an area of at least 3 $mm^2$.

12. The female electrical connector as claimed in claim 1, wherein the plurality of tabs includes at least two claws and at least two vanes, and wherein the claws and the vanes alternate around a periphery of the ring such that respective angles between the respective bases of adjacent claws and vanes on the periphery of the ring are always the same.

13. The female electrical connector as claimed in claim 12, wherein the respective angles between the respective bases of adjacent claws and vanes on the periphery of the ring are one of 45°, 30°, and 22.5°.

14. The female electrical connector as claimed in claim 1, wherein when the female electrical connector is connected with the male electrical connector, a force required to extract the female electrical connector from the male electrical connector is at least 1.4 times greater than a force required to insert the female electrical connector onto the male electrical connector.

15. The female electrical connector as claimed in claim 14, wherein the force required to insert the female electrical connector onto the male electrical connector is at most 60 N, and the force required to extract the female electrical connector from the male electrical connector is at least 80 N.

16. The female electrical connector as claimed in claim 15, wherein the force required to insert the female electrical connector onto the male electrical connector is at most 55 N, and the force required to extract the female electrical connector from the male electrical connector is at least 90 N.

17. The female electrical connector as claimed in claim 1, wherein the width of the vane base is at least 2 times smaller than the width of the claw base.

18. The female electrical connector as claimed in claim 1, wherein the width of the vane head is at least 2 times larger than the width of the vane base.

19. The female electrical connector as claimed in claim 1, wherein when the female electrical connector is connected with the male electrical connector, a force required to extract the female electrical connector from the male electrical connector is at least 1.5 times greater than a force required to insert the female electrical connector onto the male electrical connector.

20. A male electrical connector comprising:

at least one appendage extending along a central axis thereof, the appendage being configured to collaborate with a female electrical connector including a distal wiring part configured to be connected to an electric cable, and a proximal connection part including a ring having an opening therethrough, the opening being aligned with a central axis of the ring, and a plurality of tabs connected to the ring, each tab including a base attached to the ring and a head distant from the ring, the head of each tab contacting the appendage so as to provide an electrical connection when the female electrical connector is connected to the male electrical connector, the plurality of tabs including at least one claw that is a retaining tab in a shape of a claw, a base of the claw extending directly from a circumference of the opening in the ring in a direction of extension substantially perpendicular to the central axis of the ring, and a head of the claw being bent away from the base of the claw so as to extend in a direction transverse to the direction of extension of the base of the claw, and at least one vane that is an electrical connection tab in a shape of a vane, a base of the vane extending directly from the inner circumference of the opening in the ring in the direction of extension substantially perpendicular to the central axis of the ring, and a direction of extension of a head of the vane extending in a direction transverse to the direction of extension of the base of the vane, and wherein the shape of the vane is distinct from the shape of the claw, wherein a width of a base of the vane is smaller than a width of the base of the claw, and wherein the appendage includes at least one flat face.

21. The male electrical connector as claimed in claim 20, comprising at least two appendages each extending along respective central axes thereof, each appendage including at least one flat face, wherein the female electrical connector includes two rings, and wherein a distance between the respective flat faces is greater than a sum of respective widths of the two rings.

* * * * *